US009192812B2

(12) United States Patent
Li

(10) Patent No.: US 9,192,812 B2
(45) Date of Patent: Nov. 24, 2015

(54) JAW EXERCISE DEVICE

(75) Inventor: Jiangming Li, Shijiazhuang (CN)

(73) Assignee: EMPIRE TECHNOLOGY DEVELOPMENT LLC, Wilmington, DE (US)

( * ) Notice: Subject to any disclaimer, the term of this patent is extended or adjusted under 35 U.S.C. 154(b) by 729 days.

(21) Appl. No.: 13/255,237

(22) PCT Filed: Aug. 23, 2010

(86) PCT No.: PCT/CN2010/076238

§ 371 (c)(1),
(2), (4) Date: Feb. 22, 2012

(87) PCT Pub. No.: WO2012/024828

PCT Pub. Date: Mar. 1, 2012

(65) Prior Publication Data

US 2012/0142498 A1 Jun. 7, 2012

(51) Int. Cl.

| | |
|---|---|
| ***A63B 23/03*** | (2006.01) |
| ***B25G 1/10*** | (2006.01) |
| *A63B 21/02* | (2006.01) |
| *A63B 21/00* | (2006.01) |

(52) U.S. Cl.

CPC ..... *A63B 23/032* (2013.01); *A63B 23/03* (2013.01); *B25G 1/10* (2013.01); *B25G 1/102* (2013.01); *A63B 21/026* (2013.01); *A63B 21/1492* (2013.01)

(58) Field of Classification Search

CPC ..... A61B 17/28; A61B 17/2804; A61B 17/2812; A61B 17/2816; A61B 17/2841; A61B 2017/2845; A61B 2017/2904; A61B 2017/2908; A61B 2017/2919; A63B 23/032; A63B 71/085; B25B 1/005; B25B 1/10; B25B 1/102; B25B 1/105; B25G 3/38; Y10T 16/476; A61C 5/14; A61F 5/566

USPC ..... 482/10, 11; 600/219, 237–239; 606/205–209; 433/4; 81/302, 318, 395, 81/402, 485; 602/902; 128/848, 859–862

See application file for complete search history.

(56) References Cited

U.S. PATENT DOCUMENTS

| | | | | | |
|---|---|---|---|---|---|
| 390,561 | A | * | 10/1888 | Brown | 600/195 |
| 485,609 | A | * | 11/1892 | Casebeer | 433/93 |
| 1,025,265 | A | * | 5/1912 | Grindle | 600/219 |

(Continued)

FOREIGN PATENT DOCUMENTS

| | | |
|---|---|---|
| CN | 2174177 A | 8/1994 |
| CN | 1439351 A | 9/2003 |

OTHER PUBLICATIONS

"Myofunctional orthodontics," accessed at http://www.myoresearch.com/cms/index.php?tmj, accessed on Aug. 19, 2014, pp. 1-2.

(Continued)

*Primary Examiner* — Oren Ginsberg
*Assistant Examiner* — Gregory Winter
(74) *Attorney, Agent, or Firm* — Maschoff Brennan

(57) ABSTRACT

A device for opening and/or exercising a jaw can include first and second bite members configured for opening the jaw and an anatomically bent portion configured for positioning a pivot member adjacent to the TMJ. The device may be configured such that the bite members may be capable of opening and closing along an axis of rotation in common with an axis of rotation of the temporomandibular joint.

27 Claims, 5 Drawing Sheets

(56) References Cited

U.S. PATENT DOCUMENTS

| | | | | | |
|---|---|---|---|---|---|
| 1,465,259 | A | * | 8/1923 | Friedman | 600/227 |
| 1,679,497 | A | * | 8/1928 | Reeves | 606/118 |
| 2,075,534 | A | * | 3/1937 | McCormack | 600/219 |
| 2,253,132 | A | * | 8/1941 | Malson | 433/158 |
| 2,535,005 | A | * | 12/1950 | Wiprud | 433/138 |
| 2,698,483 | A | * | 1/1955 | Berkowitz | 433/156 |
| 3,813,096 | A | * | 5/1974 | Welch | 482/11 |
| 4,280,696 | A | * | 7/1981 | Ramon | 482/11 |
| 4,634,166 | A | * | 1/1987 | Pool | 294/103.1 |
| 4,955,367 | A | * | 9/1990 | Homsy | 601/38 |
| 5,062,191 | A | * | 11/1991 | Carr | 29/229 |
| 5,097,820 | A | * | 3/1992 | Shulman et al. | 600/237 |
| 5,176,594 | A | | 1/1993 | Lee | |
| 5,183,057 | A | | 2/1993 | Syrop | |
| 5,591,176 | A | * | 1/1997 | Henderson et al. | 606/137 |
| 5,681,349 | A | * | 10/1997 | Sugarbaker | 606/207 |
| 5,746,703 | A | * | 5/1998 | Levatino | 601/38 |
| 5,931,777 | A | * | 8/1999 | Sava | 600/213 |
| 6,558,392 | B1 | * | 5/2003 | Martini | 606/90 |
| 2003/0088158 | A1 | * | 5/2003 | Chien | 600/237 |
| 2004/0230221 | A1 | * | 11/2004 | Gadberry et al. | 606/205 |
| 2007/0012319 | A1 | | 1/2007 | Frascati | |
| 2010/0011916 | A1 | | 1/2010 | Christensen | |
| 2011/0230725 | A1 | * | 9/2011 | Li | 600/210 |
| 2013/0252197 | A1 | * | 9/2013 | Harden | 433/31 |

OTHER PUBLICATIONS

International Search Report and Written Opinion mailed Jun. 2, 2011 in related PCT Application No. PCT/CN2010/076238.

* cited by examiner

Fig. 3B"

JAW EXERCISE DEVICE

CROSS-REFERENCE TO RELATED APPLICATIONS

The present application is a U.S. National Stage filing under 35 U.S.C. §371 of International Application No. PCT/CN2010/076238, filed on Aug. 23, 2010.

BACKGROUND

Temporomandibular joint disorder (TMJD or TMD), or temporomandibular joint syndrome, is an umbrella term covering acute or chronic inflammation of the temporomandibular joint (TMJ), which connects the mandibular jaw to the skull. The temporomandibular joint, which is located in front of each ear, is commonly referred to as the TMJ. Various temporomandibular dysfunctions are also commonly referred to as TMJ.

TMJ disorder and resultant dysfunction can result in significant pain and impairment. The temporomandibular joint is susceptible to many of the conditions that affect other joints in the body, including ankylosis, arthritis, trauma, dislocations, developmental anomalies, and neoplasia. Ankylosis, for example, is a stiffness of the TMJ due to abnormal adhesion and rigidity of the bones of the joint, which may be the result of injury or disease. The rigidity may be complete or partial and may be due to inflammation of the tendinous or muscular structures outside the joint or of the tissues of the joint itself.

Exercise of facial muscles is a recommended manner to help avoid, reverse or at least delay the onset of TMJ disorders. In addition, patients who receive treatment to correct problems associated with the TMJ need to exercise their jaw to facilitate proper healing. Further, the exercise of the facial muscles concurrently provides exercise to the supporting neck muscles and in many cases a release of the tightness and associated with stress related tension of those muscles.

SUMMARY

A device for opening a jaw and/or exercising a jaw is disclosed. In one aspect, the device includes bite members configured for opening the jaw and an anatomically bent portion configured for positioning a pivot member adjacent to the TMJ. The device is configured such that the bite members open and close along an axis of rotation in common with an axis of rotation of the TMJ. As such, the device can open and close the jaw with the bite members staying in contact with the one or more teeth at the same location on the teeth. As such, the device can open and close the jaw without the bite members damaging the teeth by sliding along the occlusal surfaces of the teeth.

In one embodiment, a jaw exercise device includes a first bite member pivotally coupled to a second bite member. Each of the first and second bite members may be joined to first ends (e.g., proximal ends) of first and second arms that each include an anatomically bent portion, a pivot member positioned at a second end (e.g., distal end) of the anatomically bent portion, and a handle portion coupled to the pivot member and configured to open and close the first and second bite members. According to one aspect, the anatomically bent portions, the pivot members, and the first and second bite members may be arranged such that the first and second bite members are configured to open and close along an axis of rotation in common with an axis of rotation of a human or animal jaw.

In another embodiment, a jaw exercise device includes a maxillary member pivotally coupled to a mandibular member. The maxillary member and the mandibular member may be configured to cooperatively open a mandibular jaw relative to a maxillary jaw. The maxillary member includes a first bite member separated from a first handle portion by a first anatomically shaped arm, with the first anatomically shaped arm including a first pivot member configured to be positioned adjacent to or axially aligned with a temporomandibular joint (TMJ) when the first bite member is positioned between a subject's teeth. Likewise, the mandibular member includes a second bite member separated from a second handle portion by a second anatomically shaped arm, with the second anatomically shaped arm including a second pivot member configured to be positioned adjacent to or axially aligned with the TMJ when the second bite member is positioned between the subject's teeth. The first and second bite members and the TMJ may be configured to open and close along a common axis of rotation so as to be axially aligned.

In yet another embodiment, a method for opening a jaw and/or exercising a jaw is disclosed. The method includes providing a first jaw opening device that includes a first bite member pivotally coupled to a second bite member. The first and second bite members may be joined to first and second arms that each include a pivot member that is configured to be positioned adjacent to or axially aligned with a temporomandibular joint (TMJ) when the first and second bite members are positioned between a subject's teeth. The method further includes inserting the first and second bite members between the subject's teeth, positioning the pivot members adjacent to the subject's temporomandibular joint (TMJ), and separating the first and second bite members to open the subject's jaw. The first and second bite members and the TMJ may be configured to open and close along a common axis of rotation. A second jaw opening device can be used similarly for the other side of the jaw.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

FIG. 3B" illustrates a bite member having a textured surface, according to one embodiment of the present disclosure;

DETAILED DESCRIPTION

Figure 1:
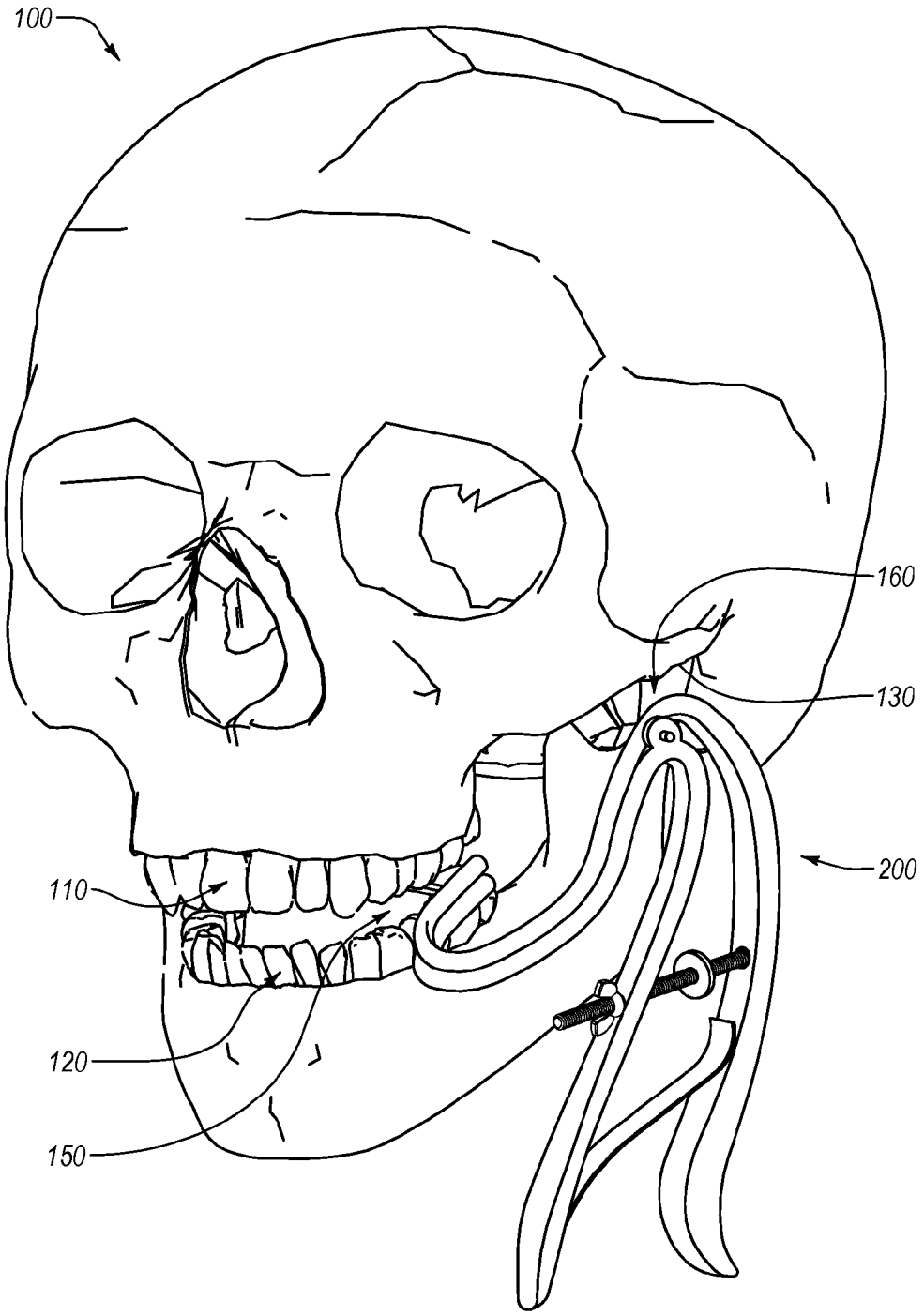
FIG. 1 schematically illustrates a skull and a device configured for opening and/or exercising a jaw, according to one embodiment of the present disclosure.

The following description sets forth various examples along with specific details to provide a thorough understanding of claimed subject matter. It will be understood by those skilled in the art, however, that claimed subject matter may be practiced without some or more of the specific details disclosed herein. Further, in some circumstances, well-known methods, procedures, systems, components and/or circuits have not been described in detail in order to avoid unnecessarily obscuring claimed subject matter.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

I. Jaw Exercise Devices

A device for opening a jaw and/or exercising a jaw is disclosed. In one aspect, the device includes bite members configured for opening the jaw and an anatomically bent portion configured for positioning a pivot member adjacent to the TMJ. The device may be configured such that the bite members open and close along an axis of rotation in common with an axis of rotation of the TMJ. This allows the bite members to contact and maintain contact to one or more teeth during opening and closing. As such, the device can open and close the jaw without the bite members damaging the teeth by sliding along the occlusal surfaces of the teeth.

In one embodiment, a jaw exercise device includes a first bite member pivotally coupled to a second bite member. Each of the first and second bite members may be joined to first and second arms that each include an anatomically bent portion, a pivot member positioned at a distal end of the anatomically bent portion, and a handle portion coupled to the pivot member and configured to open and close the first and second bite members. According to one aspect, the anatomically bent portions, the pivot members, and the first and second bite members may be arranged such that the first and second bite members can be opened and closed along an axis of rotation that is the same or substantially the same as the axis of rotation of a human or animal jaw. Suitable examples of animal species (other than humans) that the device disclosed herein could be adapted to include, but are not limited to, equine, bovine, porcine, ovine, canine, feline, and the like.

In one aspect, the first and second bite members of the device may be configured to be inserted between a subject's teeth to open the subject's mouth. For example, the first and second bite members may be configured to be inserted between a subject's molar teeth. As such, in one aspect, the device can be used to exercise a subject's jaw after an oral surgical procedure or to aid in treatment of a condition associated with the TMJ. In another aspect, the device can be used to open a subject's mouth and hold it in an opened position during an oral procedure such as, but not limited to, a dental procedure or an oral surgical procedure.

The anatomically bent portion of the device includes a first curved portion configured to be positioned adjacent to at least one molar tooth of a maxillary and/or a mandibular jaw when the first and second bite members are inserted between a subject's teeth, a second curved portion configured to curve around a portion of an oral opening when the first and second bite members are inserted between a subject's teeth, a third curved portion configured to position the pivot member adjacent to a subject's temporomandibular joint (TMJ) when the first and second bite members are inserted between the subject's teeth, and a pivot member that includes a post member in the first arm and a hole member in the second arm configured to receive the post member. In one embodiment of the device, the anatomically bent portions, the pivot members, and the first and second bite members may be arranged such that the pivot members are positionable adjacent to or axially aligned with a subject's temporomandibular joint (TMJ) so as to open the first and second bite members substantially along the axis of rotation of the human jaw.

In one embodiment, the handle portion of the first and second arms of the device may be configured for manual manipulation of the first and second bite members. The handle portion further includes a biasing member and a spring member. The biasing member can be configured to bias the first and second bite members in an opened position and the spring member can be configured to bias the first and second bite members in a closed position. The biasing member can be further configured to include a stop member configured to limit how far the first and second bite members can be separated.

In another embodiment, a jaw exercise device includes a maxillary member pivotally coupled to a mandibular member. The maxillary member and the mandibular member may be configured to cooperatively open a mandibular jaw relative to a maxillary jaw. In one aspect, the maxillary member includes a first bite member separated from a first handle portion by a first anatomically shaped arm, with the first anatomically shaped arm including a first pivot member configured to be positioned adjacent to a temporomandibular joint (TMJ) when the first bite member is positioned between a subject's teeth. In another aspect, the mandibular member includes a second bite member separated from a second handle portion by a second anatomically shaped arm, with the second anatomically shaped arm including a second pivot member configured to be positioned adjacent to the TMJ when the second bite member is positioned between the subject's teeth. The first and second bite members and the TMJ are configured to open and close along a substantially common axis of rotation. Slight variation from the TMJ axis of rotation may be allowable.

As with the previously described embodiment, the first and second anatomically shaped arms, the pivot members, and the first and second bite members may be arranged such that the pivot members are positionable adjacent to or axially aligned with a subject's temporomandibular joint (TMJ) so as to open the first and second bite members along the axis of rotation of the human jaw.

Referring now to FIG. 1, a human skull 100 is illustrated with an example of a jaw exercise device 200. For the sake of clarity, the skull 100 is shown without flesh in order to illustrate the relationship between the anatomical features of the skull 100 and the device 200. As shown in the example, a first portion 150 of the device 200 may be inserted between the maxillary jaw 110 and the mandibular jaw 120. Meanwhile, a pivot portion 160 of the device 200 may be arranged adjacent to or axially aligned with the temporomandibular joint (TMJ) 130. With the device 200 so arranged, the device 200 can be used to separate the mandibular jaw 120 from the maxillary jaw 110 without damage to the teeth. That is, for example, the device 200 may be configured such that the pivot portion 160 may be positioned adjacent to or axially aligned with the TMJ 130 such that the first portion 150 and the jaw 110 and 120 open along the same or substantially the same axis of rotation.

In operation, the first portion 150 of the device 200 may be inserted in between the maxillary 110 and mandibular 120 jaws and the pivot portion 160 may be positioned adjacent to the TMJ 130. So positioned, the first portion 150 of the device 200 can be opened to separate the maxillary 110 and mandibular jaws 120 with the first portion 150 of the device 200 opening along the same or substantially the same axis of rotation as the maxillary 110 and mandibular jaws 120. As such, the device can exercise the user's jaw without the first portion 150 of the device 200 sliding along and damaging the occlusal surface of the teeth. The device may be positioned correctly when the first portion 150 does not move substantially in relation to the occlusal surface of the teeth during opening or closing. The device 200 may be configured such that when the pivot portion 160 pivots along with the TMJ 130 so as to pivot on substantially the same axis as the TMJ 130, the first portion 150 opens and closes while maintaining contact with the same part of the occlusal surface of the tooth or teeth without sliding on the occlusal surface.

Figure 2:
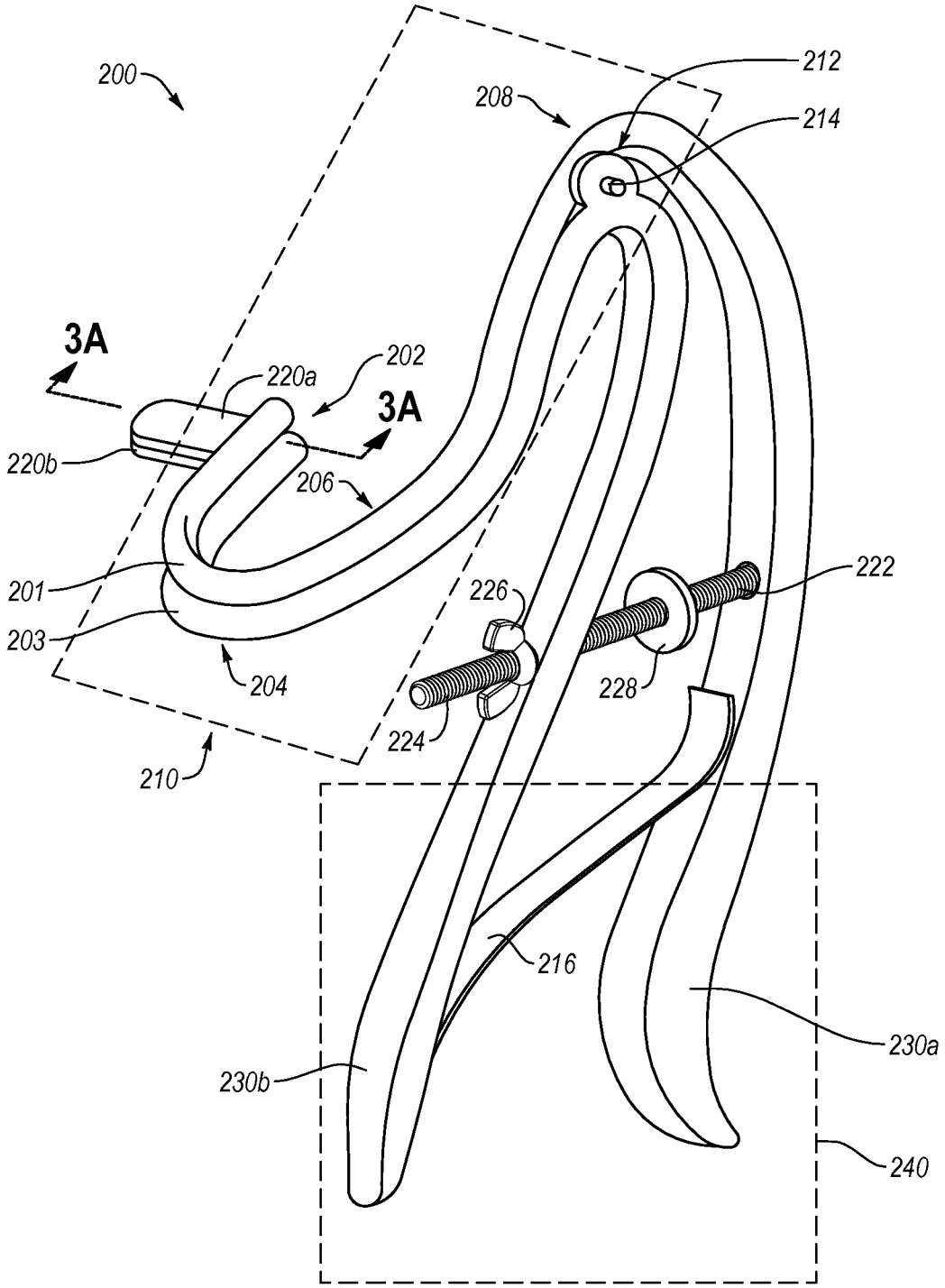
FIG. 2 illustrates a device, according to one embodiment of the present disclosure.

The device 200 shown in FIG. 1 is illustrated in greater detail in FIG. 2. As seen in FIG. 2, the device 200 includes a maxillary member 201 and a mandible member 203. The maxillary member 201 includes a first bite member 220*a* pivotally coupled to a second bite member 220*b* that is included on the mandible member 203. Each of the first and second bite members 220*a* and 220*b* may be joined to the first and second arms 230*a* and 230*b* that each include an anatomically bent portion 210, a pivot member 212 positioned at a distal end of the anatomically bent portion 210, and a handle portion 240 coupled to the pivot member 212. The bite members 220*a* and 220*b* and the handle portion 240 may be arranged such that the bite members 220*a* and 220*b* can be driven apart to open a user's jaw by manipulating the handle portion 240. In the illustrated embodiment, the bite members 220*a* and 220*b* can be driven apart by grasping and squeezing the handle portion 240. In other embodiments, the bite members 220*a* and 220*b* may be driven apart to open a user's mouth using a handle portion that may be pulled apart or with a drive mechanism such as a screw member or a hydraulic piston.

The anatomically bent portions 210 of the first and second arms 230*a* and 230*b* each includes a first portion 202 (i.e., buccal portion), a second portion 204 (i.e., oral curved portion), a third portion 206 (i.e., cheek portion) and a fourth portion 208 (i.e., pivot portion). Each first portion 202 may be joined to the first and second bite members 220*a* and 220*b* and is configured to be positioned between teeth and a buccal surface. When the first and second bite members 220*a* and 220*b* are placed between a user's teeth (e.g., the users molars), the first portion 202 of the anatomically bent portion 210 may be situated in the user's mouth adjacent to the buccal surface and to the user's molar and/or cuspid teeth. Meanwhile, the second portion 204 of the anatomically bent portion 210, which adjoins the proximal end of first portion 202, may be configured to bend around and through the user's lips to allow the remaining portions of the device 200 to be situated outside the user's mouth.

The third portion 206 of the anatomically bent portion 210 curves up and away from the second portion 204 and is configured to be located adjacent to the patient's cheek. When the first and second bite members 220*a* and 220*b* are placed between a user's teeth, the third portion 206 may be positioned adjacent to the user cheek curving up and around the user's cheek and back toward the user's ear. The fourth portion 208 of the anatomically bent portion 210, which roughly corresponds to the region around the pivot member 212, may be situated at the distal end of the third portion 206. The pivot member 212 at the distal end of the fourth portion 208 includes a post member 214 on one of the arms 230*a* or 230*b* and a hole member (not shown) configured to receive the post member 214.

When the first and second bite members 220*a* and 220*b* are placed between a user's teeth, the fourth portion 208 and/or pivot member 212 can be positioned adjacent to the TMJ such that the first and second bite members 220*a* and 220*b* and the maxillary 110 and mandibular jaws 120 (FIG. 1) can be opened along the same axis of rotation. The arrangement of the device 200 relative to the maxillary 110 and mandibular jaws 120 and the TMJ 130 can be seen in FIG. 1.

With continued reference to FIG. 2, the handle portion 240 of the device 200 optionally further includes a biasing member 222 and a spring member 216. The biasing member 222 can be configured to bias the first and second bite members 220*a* and 220*b* in an opened position and the spring member 216 can be configured to bias the first and second bite members 220*a* and 220*b* in a closed position. The spring member 216 shown on FIG. 2 may be a leaf spring. In other embodiments, other springs such as but not limited to coil springs, elastomers, and hydraulic pistons can be used as a spring member 216 to bias the first and second bite members 220*a* and 220*b* in a closed position.

In one embodiment, the biasing member 222 includes helical threads 224. In one embodiment, the biasing member 222 includes a first nut member 226 that can be positioned along the length of the helical threads 224 to set first and second bite members 220*a* and 220*b* in an opened position. In addition, the biasing member 222 optionally further includes a stop member 228 (e.g., a second nut member) that can be positioned along the length of the helical threads 224 to set a distance by which the first and second bite members 220*a* and 220*b* can be separated.

For example, if a user is using the device to exercise their jaw after oral surgery, the first nut member 226 can be used to assist the opening of the mouth by turning the nut member 226 along the helical threads 224 or the nut member can be set to hold the jaw in an opened position. In another example, it may also be useful to limit how far the mouth can be opened after an oral surgical procedure. In that case, the stop member 228 can be used to limit how far the mouth can be opened. As the user heals following surgery, for example, the nut member 226 and the stop member 228 can be set to allow an increased range of jaw movement.

In one embodiment, the device 200 may be fabricated (e.g., by molding, forging, stamping, or machining) using a material including, but not limited to, stainless steel, titanium, nickel-titanium alloy, aluminum and aluminum alloys, and polymeric materials such as, but not limited to, polystyrene and nylon, polyimide, polyamide-imide, polyether ether ketone, and the like.

In one embodiment, the first and second bite members 220*a* and 220*b* project lingually (i.e., toward the tongue from the check side of the teeth) from the first curved portion when the first and second bite members 220*a* and 220*b* may be inserted between the subject's molar teeth.

Figure 3A:
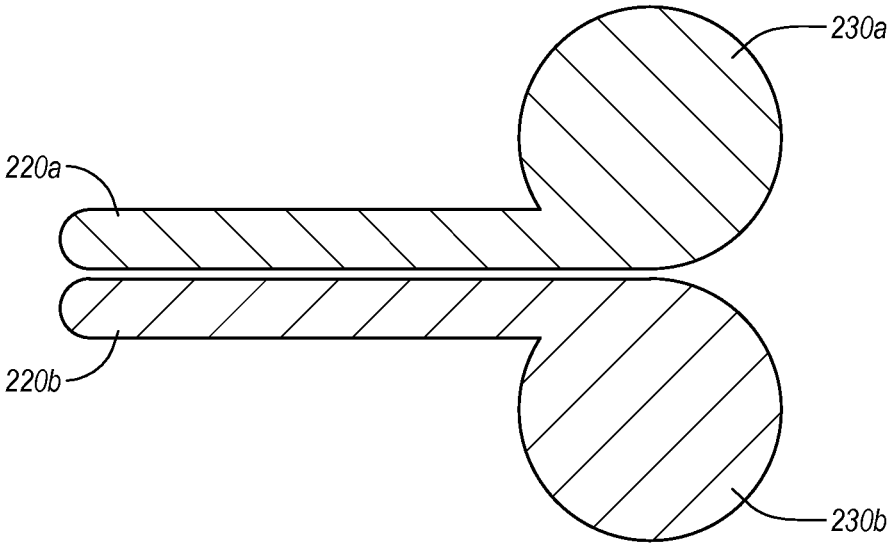
FIG. 3A illustrates a cross section of the bite members of the device taken along line 3A-3A of FIG. 2.

Referring now to FIG. 3A, a cross-section showing the first and second bite members 220*a* and 220*b* and the first and second arms 230*a* and 230*b* is shown. In the embodiment shown in FIG. 3A the first and second bite members 220*a* and 220*b* may be integrally formed (e.g., co-molded, forged, or the like) with one another. In other embodiments, the arms 230*a* and 230*b* and the bite members 220*a* and 220*b* can be formed separately and then attached to one another. By way of example and without limitation, arms 230*a* and 230*b* and bite members 220*a* and 220*b* can be attached to one another using fasteners such as bolts and screws, welding, and glues.

In one embodiment, the first and second bite members 220*a* and 220*b* may be posts. That is, the first and second bite members 220*a* and 220*b* can be configured as relatively flattened rod-like projections that extend from the first and second arms 230*a* and 230*b*. In another embodiment, the first and second bite members 220*a* and 220*b* may be configured as plates. In some instances, plates may be favored for some users due to the fact that plates have a larger surface area, which allows them to distribute the forces placed on the teeth and the jaw over a wider surface area. In yet another embodiment, the first and second bite members 220*a* and 220*b* may be custom-made for individual patients. For example, the size and shape of the first and second bite members 220*a* and 220*b* may be based on a mold of a patient's teeth. The custom approach may be favored for some patients with unusual dentition, missing teeth, oral disease, and the like.

In one embodiment, the first and second bite members 220*a* and 220*b* can be configured to receive a protective sleeve. A protective sleeve can be a sleeve designed to protect the user's teeth from marring or abrasion by the first and second bite members 220*a* and 220*b*. For example, if the device is made from a metallic material such as stainless steel, the user's teeth may be damaged if the steel first and second bite members 220*a* and 220*b* may be placed directly against the teeth, and the device 200 may be used to force the mouth open. Moreover, if the user has metallic fillings or crowns, the user may experience discomfort due to a possible electrical discontinuity between the device and the metallic first and second bite members 220*a* and 220*b*.

Figure 3B:
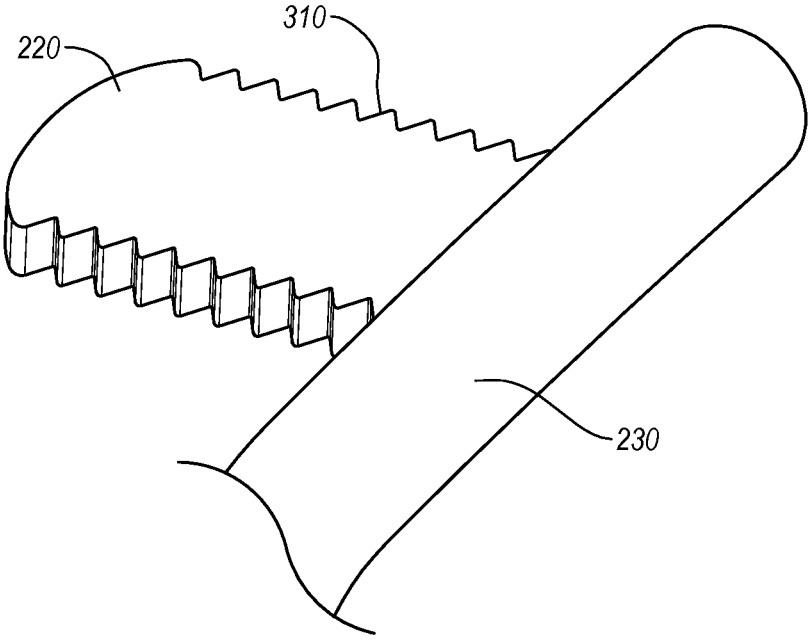
FIG. 3B' illustrates a bite member having a textured edge, according to one embodiment of the present disclosure.
Figure 3C:
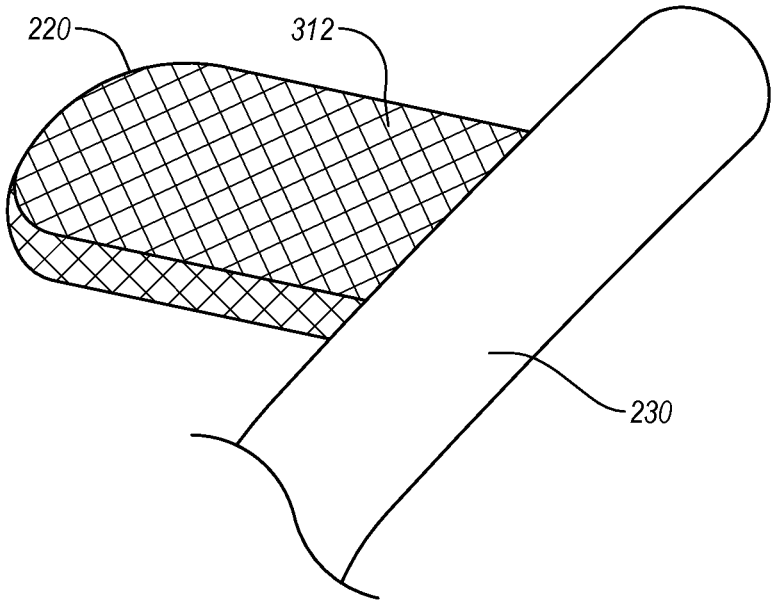
FIG. 3C illustrates a protective sleeve that can be placed over a bite member, according to one embodiment of the present disclosure.
Figure 3C:
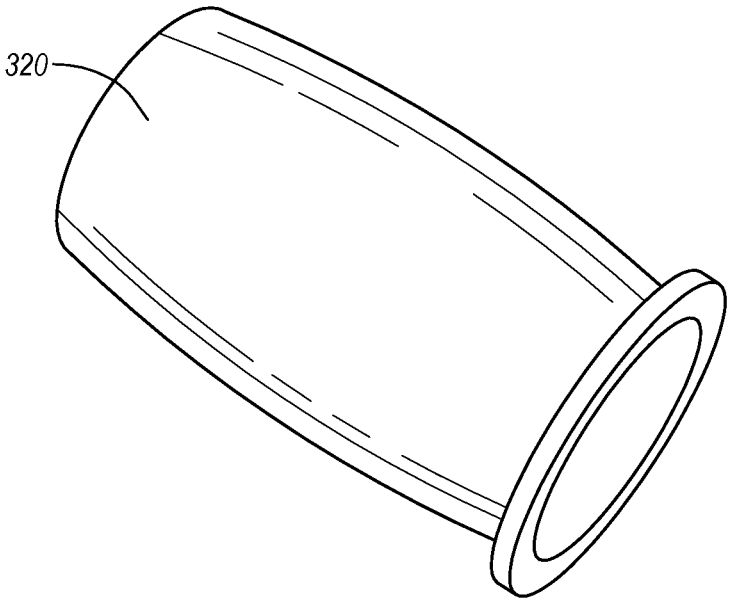

An example of a protective sleeve, according to one embodiment, is shown in FIG. 3C. The protective sleeve 320 can be fabricated from resilient, flexible, and or cushioning material. Suitable examples of materials that can be used to fabricate the protective sleeve include, but are not limited to, a silicon rubber, a silica gel, a latex rubber, a synthetic rubber, or combinations thereof.

Referring now to FIGS. 3B' and 3B", the first and second bite members 220*a* and 220*b* can further include features such as, but not limited to, a textured surface configured to retain the protective sleeve (e.g., protective sleeve 320). A textured surface can help to retain the protective sleeve by providing features on the surface of the first and second bite members 220*a* and 220*b* that the protective sleeve can grip onto. For example, as shown in FIG. 3B', the bite member 220 includes a scalloped or serrated edge 310. In another example, as shown in FIG. 3B", the bite member 220 optionally includes a cross-hatched or knurled surface 312. In other embodiments, the surface of the first and second bite members may be textured by for example sanding, sand blasting, molding surface projections into the bite members (e.g., a rough surface with a sand-like appearance), and the like.

Figure 4:
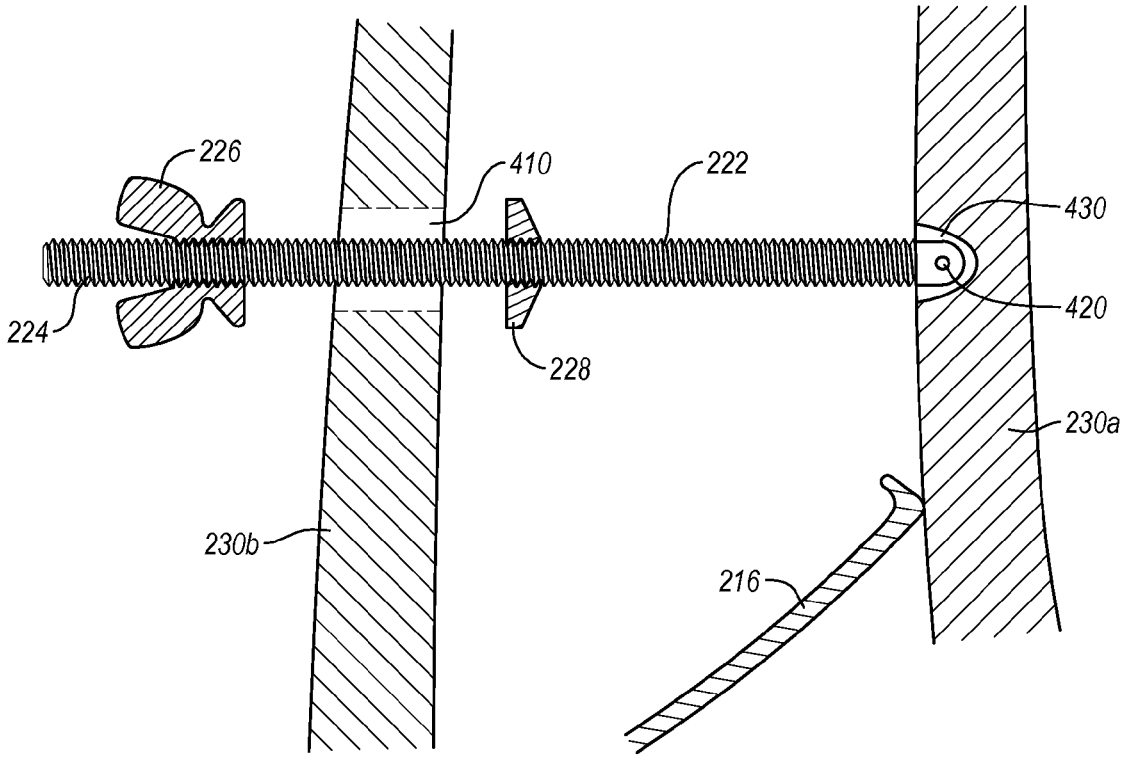
FIG. 4 depicts a detailed view of the device of FIG. 2 illustrating a biasing member and a spring member, according to one embodiment of the present disclosure.

Referring now to FIG. 4, the biasing member 222 and a spring member 216 are shown in greater detail. As discussed in relation to FIG. 2, the biasing member 222 can be configured to bias the first and second bite members 220*a* and 220*b* in an opened position. As shown in FIG. 4, the biasing member 222 optionally includes helical threads 224 along essentially its entire length. In other embodiments, the biasing member can include threads 224 along only a portion of its length.

In the illustrated embodiment, the biasing member 222 passes through the arm 230*b* via hole member 410. The biasing member attaches to opposite arm 230*a* via a second hole member 430. In the illustrated embodiment, biasing member 222 attaches in hole member 430 via pivot 420. As can be seen in FIG. 4, hole member 430 may be angled to the biasing member 222 to pivot up and down when the arms 230*a* and 230*b* may be squeezed together or drawn apart. As such, pivot 420 may be configured to attach biasing member 222 to arm 230*a* while allowing the biasing member 222 to pivot up and down.

II. Methods for Opening a Jaw

In yet another embodiment, a method for opening a jaw is disclosed. The method includes providing a first jaw opening device that includes a first bite member pivotally coupled to a second bite member. The first and second bite members may be joined to first and second arms that each include a pivot member that may be configured to be positioned adjacent to a temporomandibular joint (TMJ) when the first and second bite members may be positioned between a subject's teeth. The method further includes inserting the first and second bite members between the subject's teeth, positioning the pivot members adjacent to the subject's temporomandibular joint (TMJ), and separating the first and second bite members to open the subject's jaw. The first and second bite members and the TMJ may be configured to open and close along a common axis of rotation.

In one embodiment, the method further includes providing a second jaw opening device that can be used to open the subject's jaw in cooperation with the first jaw opening device. The use of a second jaw opening device in cooperation with the first jaw opening device can better distribute the forces on the teeth and the jaw. Likewise, the use of a second jaw opening device in cooperation with the first jaw opening device can facilitate symmetrical opening of the jaw, which may be favored for correcting a number of TMJ issues.

The method using the second jaw opening device includes inserting the first jaw opening device between the subject's teeth on a first side of the subject's mouth, inserting the second jaw opening device between the subject's teeth on a second, opposite side of the subject's mouth, positioning the pivot members of the first and second jaw opening devices adjacent to the TMJs on corresponding sides of the subject's mouth, and simultaneously separating the first and second bite members of the first and second jaw opening devices to open the subject's jaw.

In one embodiment, the act of positioning the pivot members adjacent to the subject's temporomandibular joint (TMJ) can be used to adapt the device to users having different jaw sizes. In some cases, a doctor or another medical practitioner can instruct a user to insert the device between their teeth and position the pivot member adjacent to their TMJ (i.e., adjacent to their ear lobe). With the device so positioned, the device should open along the same or substantially the same axis of rotation as the user's jaw.

In another embodiment, a few differently sized devices can be provided for opening the jaws of users having different jaw sizes. As such, in one aspect, the method further includes selecting a first jaw opening device sized for the subject's jaw and selecting a second jaw opening device sized for a second subject's jaw, where the first jaw opening device may be sized differently than the second jaw opening device. Nevertheless, because the devices can be adapted for an individual's jaw by inserting the bite members between the teeth and positioning the pivot member adjacent to the TMJ, it may be possible to limit manufacturing to just a few (e.g., two, three, or four) different sizes of devices.

It will be understood by those within the art that, in general, terms used herein, and especially in the appended claims (e.g., bodies of the appended claims) may be generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

As used herein, the term "substantially" is used to mean to a great extent or degree. The term "substantially" is often used in conjunction with another term to describe the extent or degree of that term such as, but not limited to, angles, shapes, and states of being. For example, the term "substantially perpendicular" may be used to indicate some degree of leeway in an angular measurement. That is, an angle that is "substantially perpendicular" may be 90°, but angles such as 45°, 60°, 65°, 70°, 75°, 80°, 85°, 95°, 100°, 105°, 110°, 115°, 120°, 125°, 130°, or 135° may also be considered to be "substantially perpendicular." Similarly, "substantially" may be used in conjunction with a shape term such as "substantially cylindrical" to indicate that the object referred to may have a circular profile or an ovoid profile. Likewise, a term describing a state of being such as the term "substantially closed," may be used to indicate that something is mostly closed or usually closed, but that it need not be 100% closed or always closed.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. A device, comprising:

a first bite member pivotally coupled to a second bite member;

a first arm joined to the first bite member, the first arm having a first anatomically bent portion between the first bite member and a first pivot member and having a first handle portion joined to the first pivot member opposite of the first anatomically bent portion, wherein the first anatomically bent portion extends forward from the first bite member, then curves around to extend backward, and then curves upward to extend backward and upward to the first pivot member; and a second arm joined to the second bite member, the second arm having a second anatomically bent portion between the second bite member and a second pivot member and having a second handle portion joined to the second pivot member opposite of the second anatomically bent portion, wherein the second anatomically bent portion extends forward from the second bite member, then curves around to extend backward, and then curves upward to extend backward and upward to the second pivot member, wherein the first arm and second arm are contoured together from the first and second bite members to the first and second pivot members, wherein the first handle portion and second handle portion are separated when the first and second bite members are in a closed orientation and are closed together when the first and second bite members are in an open orientation, wherein the first and second anatomically bent portions, the first and second pivot members, and the first and second bite members are arranged such that the first and second bite members are configured to open and close along an axis of rotation in common with an axis of rotation of a temporomandibular joint (TMJ).

2. The device of claim 1, wherein the first and second bite members are configured to be inserted between a subject's teeth to open the subject's mouth.

3. The device of claim 1, wherein the first and second bite members are configured to be inserted between a subject's molar teeth.

4. The device of claim 3, wherein the first and second bite members project lingually from the first and second anatomically bent portions when the first and second bite members are inserted between the subject's molar teeth.

5. The device of claim 1, wherein the first and second anatomically bent portions, the first and second pivot members, and the first and second bite members are arranged such that the first and second pivot members are positionable adjacent to a subject's temporomandibular joint (TMJ) so as to open the first and second bite members along the axis of rotation of a human jaw.

6. The device of claim 1, wherein the first and second anatomically bent portions each includes a buccal portion configured to be positioned adjacent to a buccal surface and to at least one molar tooth of a maxillary and/or a mandibular jaw when the first and second bite members are inserted between a subject's teeth.

7. The device of claim 1, wherein the first and second anatomically bent portions each includes an oral curved portion configured to curve around a portion of an oral opening when the first and second bite members are inserted between a subject's teeth.

8. The device of claim 1, wherein the first and second anatomically bent portions includes a cheek portion configured to be positioned adjacent to a cheek surface and position the first and second pivot members adjacent to a subject's temporomandibular joint (TMJ) when the first and second bite members are inserted between the subject's teeth.

9. The device of claim 1, wherein the first and second handle portions are configured to perform manual manipulation of the first and second bite members.

10. The device of claim 1, further comprising a biasing member coupled between the first and second handle portions and configured to bias the first and second bite members in the closed orientation.

11. The device of claim 1, further comprising a biasing member coupled between the first and second handle portions that can be configured to bias the first and second bite members in the open orientation.

12. A device, comprising:

a maxillary member pivotally coupled to a mandibular member such that the maxillary member and the mandibular member are configured to be in a closed orientation when a mandibular jaw is closed relative to a maxillary jaw and to be in an open orientation when the mandibular jaw is open relative to a maxillary jaw;

the maxillary member including:

a first bite member separated from a first handle portion by a first anatomically shaped arm, the first anatomically shaped arm including a first pivot member configured to be positioned adjacent to a temporomandibular joint (TMJ) when the first bite member is positioned between a subject's teeth;

the mandibular member including:

a second bite member separated from a second handle portion by a second anatomically shaped arm, the second anatomically shaped arm including a second pivot member pivotally coupled to the first pivot member and configured to be positioned adjacent to the TMJ when the second bite member is positioned between the subject's teeth;

wherein:

the first and second bite members and the TMJ are configured to open and close along a common axis of rotation;

the first anatomically shaped arm includes:

a first buccal portion coupled to the first bite member, wherein the first buccal portion extends forward from the first bite member;

a first oral curved portion coupled to the first buccal portion, wherein the first oral curved portion curves around to extend backward; and a first cheek portion that is coupled to the first oral curved portion and the first pivot member and that curves upward to extend backward and upward to the first pivot member;

the second anatomically shaped arm includes:

a second buccal portion coupled to the second bite member, wherein the second buccal portion extends forward from the second bite member;

a second oral curved portion coupled to the second buccal portion, wherein the second oral curved portion curves around to extend backward; and a second cheek portion that is coupled to the second oral curved portion and the second pivot member and that curves upward to extend backward and upward to the second pivot member;

the first pivot member is positioned at a distal end of the first cheek portion; and the second pivot member is positioned at a distal end of the second cheek portion.

13. The device of claim 12, wherein the first and second anatomically shaped arms, the first and second pivot members, and the first and second bite members are arranged such that the first and second pivot members are positionable adjacent to the subject's temporomandibular joint (TMJ) so as to open the first and second bite members along the axis of rotation of the human jaw.

14. The device of claim 12, wherein the first and second bite members are configured to be inserted between the subject's teeth to open the subject's mouth.

15. The device of claim 12, wherein the first and second handle portions are configured to manually open the first and second bite members.

16. The device of claim 12, further comprising a biasing member coupled between the first and second handle portions and configured to bias the first and second bite members in the closed orientation.

17. The device of claim 12, further comprising a biasing member coupled between the first and second handle portions that can be configured to bias the first and second bite members in the open orientation.

18. A device, comprising:

a maxillary member pivotally coupled to a mandibular member such that the maxillary member and the mandibular member are configured to be in a closed orientation when a mandibular jaw is closed relative to a maxillary jaw and to be in an open orientation when the mandibular jaw is open relative to a maxillary jaw;

the maxillary member including:

a first bite member separated from a first handle portion by a first anatomically shaped arm, the first anatomically shaped arm including a first pivot member configured to be positioned adjacent to a temporomandibular joint (TMJ) when the first bite member is positioned between a subject's teeth;

the mandibular member including:

a second bite member separated from a second handle portion by a second anatomically shaped arm, the second anatomically shaped arm including a second pivot member pivotally coupled to the first pivot member and configured to be positioned adjacent to the TMJ when the second bite member is positioned between the subject's teeth;

wherein:

the first and second bite members and the TMJ are configured to open and close along a common axis of rotation;

the first and second anatomically shaped arms, the first and second pivot members, and the first and second bite members are arranged such that the first and second pivot members are positionable adjacent to a subject's TMJ so as to open the first and second bite members along the axis of rotation of the human jaw;

the first anatomically shaped arm extends forward from the first bite member, then curves around to extend backward, and then curves upward to extend backward and upward to the first pivot member; and the second anatomically shaped arm extends forward from the second bite member, then curves around to extend backward, and then curves upward to extend backward and upward to the second pivot member.

19. The device of claim 18, wherein:

the first anatomically shaped arm includes:

a first buccal portion coupled to the first bite member, wherein the first buccal portion extends forward from the first bite member;

a first oral curved portion coupled to the first buccal portion, wherein the first oral curved portion curves around to extend backward; and a first cheek portion that is coupled to the first oral curved portion and the first pivot member and that curves upward to extend backward and upward to the first pivot member;

the second anatomically shaped arm includes:

a second buccal portion coupled to the second bite member, wherein the second buccal portion extends forward from the second bite member;

a second oral curved portion coupled to the second buccal portion, wherein the second oral curved portion curves around to extend backward; and a second cheek portion that is coupled to the second oral curved portion and the second pivot member and that curves upward to extend backward and upward to the second pivot member;

the first pivot member is positioned at a distal end of the first cheek portion; and the second pivot member is positioned at a distal end of the second cheek portion.

20. The device of claim 18, wherein the first and second bite members are configured to be inserted between the subject's teeth to open the subject's mouth.

21. The device of claim 18, wherein the first and second handle portions are configured to manually open the first and second bite members.

22. The device of claim 18, further comprising a biasing member coupled between the first and second handle portions and configured to bias the first and second bite members in the closed orientation.

23. The device of claim 18, further comprising a biasing member coupled between the first and second handle portions that can be configured to bias the first and second bite members in the open orientation.

24. The device of claim 1, wherein the first bite member, a first portion of the first anatomically bent portion that extends forward from the first bite member, the second bite member, and a first portion of the second anatomically bent portion that extends forward from the second bite member are all spaced apart from the first and second pivot members and the first and second handle portions in a direction that is parallel to the axis of rotation.

25. The device of claim 1, wherein each of the first and second bite members has a custom size and shape based on a mold of a patient's teeth.

26. The device of claim 1, further comprising a first protective sleeve received around the first bite member and a second protective sleeve received around the second bite member.

27. The device of claim 26, wherein:

each of the first and second bite members includes a textured surface configured to retain the first and second protective sleeves in place around the first and second bite members; and the textured surface of each of the first and second bite members includes a scalloped edge or a knurled surface.

* * * * *